US005622489A

United States Patent [19]

Monro

[11] Patent Number: 5,622,489

[45] Date of Patent: Apr. 22, 1997

[54] FUEL ATOMIZER AND APPARATUS AND METHOD FOR REDUCING NOX

[76] Inventor: Richard J. Monro, 102 Ramapoo Rd., Ridgefield, Conn. 06877

[21] Appl. No.: 421,836

[22] Filed: Apr. 13, 1995

[51] Int. Cl.[6] ..... F23C 7/00

[52] U.S. Cl. ..... 431/187; 239/492; 239/601

[58] Field of Search ..... 431/181, 183, 431/187; 239/491, 492, 599, 601, 404

[56] References Cited

U.S. PATENT DOCUMENTS

| | | | |
|---|---|---|---|
| 1,151,258 | 8/1915 | Fischer . | |
| 1,569,448 | 5/1926 | Banner . | |
| 2,284,443 | 5/1942 | Paradise . | |
| 2,566,788 | 9/1951 | Berggren et al. | 239/404 |
| 2,613,112 | 10/1952 | Fletcher . | |
| 2,796,923 | 6/1957 | Fiske et al. | 431/183 |
| 3,633,654 | 1/1972 | Auman et al. . | |
| 3,718,122 | 2/1973 | Agrest . | |
| 3,844,484 | 10/1974 | Masai | 239/404 |
| 4,089,637 | 5/1978 | Smith et al. . | |
| 4,168,785 | 9/1979 | Gabler et al. . | |
| 4,218,020 | 8/1980 | Reider | 239/601 |
| 4,294,178 | 10/1981 | Borio et al. . | |
| 4,421,039 | 12/1983 | Llinares, Jr. . | |
| 4,570,551 | 2/1986 | Derbidge et al. . | |
| 4,591,099 | 5/1986 | Emory et al. . | |
| 4,607,794 | 8/1986 | Horwood . | |
| 4,634,054 | 1/1987 | Grusha . | |
| 5,012,893 | 5/1991 | Buchholz et al. . | |
| 5,109,824 | 5/1992 | Okamoto et al. . | |
| 5,131,334 | 7/1992 | Monro . | |
| 5,133,502 | 7/1992 | Bendig et al. . | |
| 5,146,858 | 9/1992 | Toduda et al. . | |
| 5,244,154 | 9/1993 | Buchholz et al. . | |
| 5,311,829 | 5/1994 | Clark et al. . | |
| 5,365,865 | 11/1994 | Monro . | |

*Primary Examiner*—Noah P. Kamen

*Attorney, Agent, or Firm*—St. Onge Steward Johnston & Reens

[57] ABSTRACT

A fuel atomizer using a spray plate, for a highly spun liquid fuel is described for generating spaced apart fuel rich zones separated by a fuel lean zone by forming a slot in an outer domed surface of the spray plate. The shape of the domed surface is selected so that the spinning fuel, which is also under a high pressure, is permitted to preferentially expand in the direction of the ends of the slot while increasingly spilling over a wall bounding the slot. With a fuel atomizer in accordance with the invention substantial reductions in the generation of thermal NOx can be achieved in boilers when the fuel atomizer is placed within a flame stabilizer.

11 Claims, 6 Drawing Sheets

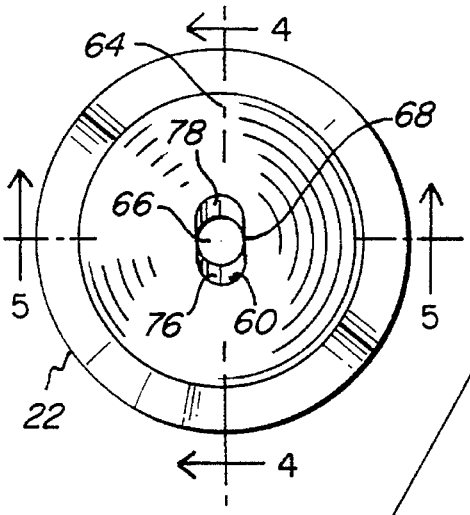
FIG. 2
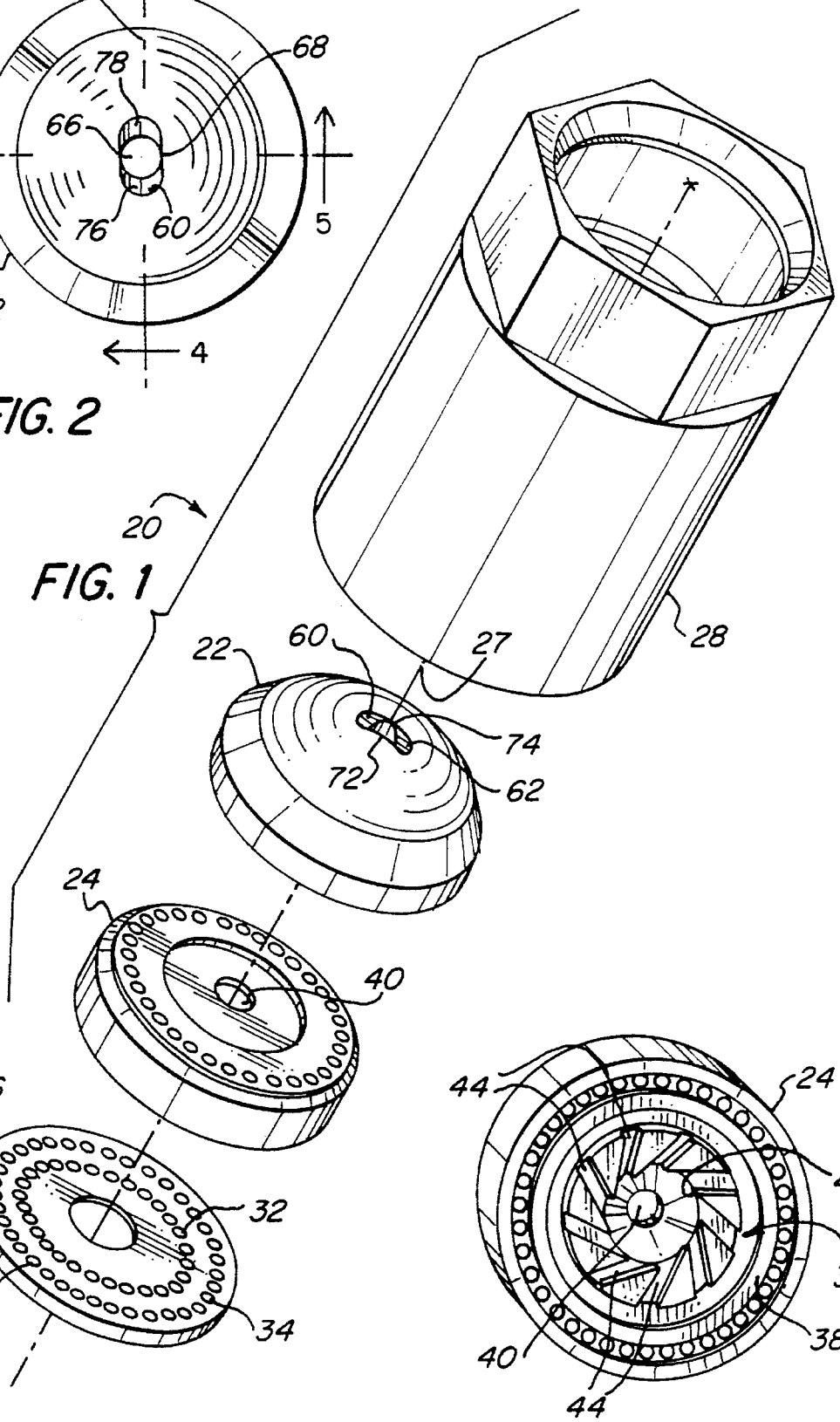
FIG. 1
FIG. 3

FUEL ATOMIZER AND APPARATUS AND METHOD FOR REDUCING NOX

FIELD OF THE INVENTION

This invention relates to a fuel atomizer capable of reducing NOx and a method for applying liquid fuel to a boiler to reduce the NOx therein. More specifically this invention relates to an apparatus for injecting fuel into a utility boiler of the tangential type in such a manner as to reduce NOx.

BACKGROUND OF THE INVENTION

Burners for tangentially fired boilers inject the fuel from atomizers in a manner as illustrated in the U.S. Pat. Nos. 4,294,178 and 5,146,858. The liquid fuel burners typically involve the application of the fuel at a very high pressure, of the order of a 1000 psi, and passing the fuel through a back plate into a whirl plate and then through a passage in a spray plate. The whirl plate directs the fuel into a spin so that the fuel emerges into the boiler with a conical pattern. A number of such fuel atomizers are used and direct the fuel tangentially at a centrally located zone where the flame is located.

An atomizer is shown in the U.S. Pat. No. 2,613,112 to Fletcher and illustrates fuel tip or spray plate having an oblong cross section so as to produce a substantially flat spray. The spray plate has an outer conical surface with a solid angle of about 90 degrees. In one embodiment the flat spray is obtained by distributing fuel passages in a diametral plane. This type of spray plate is not suitable for accommodating a highly spun fuel as is used in a tangentially fired boiler.

An electromagnetic fuel injection valve is taught by the U.S. Pat. No. 5,109,824 to Okamoto et al. and shows multiple fuel swirls entering fuel injection port of an engine. In the U.S. Pat. No. 1,569,448 to Ranner liquid fuel from two orifices impact against each other in a substantially flat elongated cavity to form a flat fuel spray. These fuel injection devices are not proposed to reduce NOx in a boiler and do not accommodate a highly spun fuel.

In a copending patent application entitled Internally Air Fuel Staged Flame Stabilizer by Richard J. Monro filed Oct. 27, 1993 bearing Ser. No. 08/144,230, now U.S. Pat. No. 5,415,114 a flame stabilizer is described with which the air flow is circumferentially staged into alternating air lean and air rich zones. The flame stabilizer described in this copending patent application has been in commercial use in connection with the burning of solid fuel for more than a year prior to the filing of the subject patent application.

SUMMARY OF THE INVENTION

With a fuel atomizer in accordance with the invention the NOx from a boiler can be significantly reduced by providing a relatively simple modification to a conventional liquid fuel atomizer of the spinning fuel type. This is achieved by providing the fuel atomizer with a spray plate in which highly spinning fuel can be preferentially guided into well defined spaced apart fuel rich zones separated by a fuel lean zone. The spray plate is provided with a discharge slot which is bounded by walls which are so shaped that spinning fuel is preferentially allowed to spill over portions of the walls so as to lead to distinct fuel patterns formed of fuel rich lobes surrounded by fuel lean zones.

A fuel pattern formed in accordance with the invention can be used with many different types of boilers. When such fuel pattern is used in a tangentially fired boiler, distinct fuel rich lobes surrounded by fuel lean zones are produced with which thermally generated NOx is reduced by an amount that can be of the order of about 50%. Such reduction in NOx can be obtained by retrofitting burners in a boiler in an efficient manner without using so-called expensive low NOx replacement burners.

When a fuel atomizer in accordance with the invention is placed inside a flame stabilizer which produces a swirl, interference with the internal circulation pattern produced by the swirler can be significantly reduced and an enhanced stability of the flame is obtained in comparison with conventional liquid fuel atomizers. Significant reductions of thermal NOx can be obtained by aligning the lobes of concentrated fuel with air lean zones separated from air rich zones produced by the swirler. In some cases a different alignment is preferred.

It is, therefore, an object of the invention to provide a method and apparatus for reducing the thermal NOx produced by a burner with a retrofit that involves the burner fuel atomizer and the addition of a flame stabilizer. It is a further object of the invention to provide a liquid fuel atomizer for a burner with which fuel rich and lean zones can be produced. It is still further an object of the invention to provide a fuel atomizer for use in tangentially fired boilers and with which thermal NOx produced by the boiler can be reduced.

BRIEF DESCRIPTION OF THE DRAWINGS

These and other advantages and objects of the invention can be understood from the following description of a preferred embodiment in accordance with the invention and as illustrated in the drawings wherein:

FIG. 1 is an exploded perspective view of a fuel atomizer in accordance with the invention;

FIG. 2 is a top view of a spray plate in accordance with the invention as used in the fuel atomizer illustrated in FIG. 1;

FIG. 3 is a perspective view of the other surface show of a whirl plate used in the atomizer of FIG. 1;

DETAILED DESCRIPTION OF THE DRAWINGS

Figure 5:
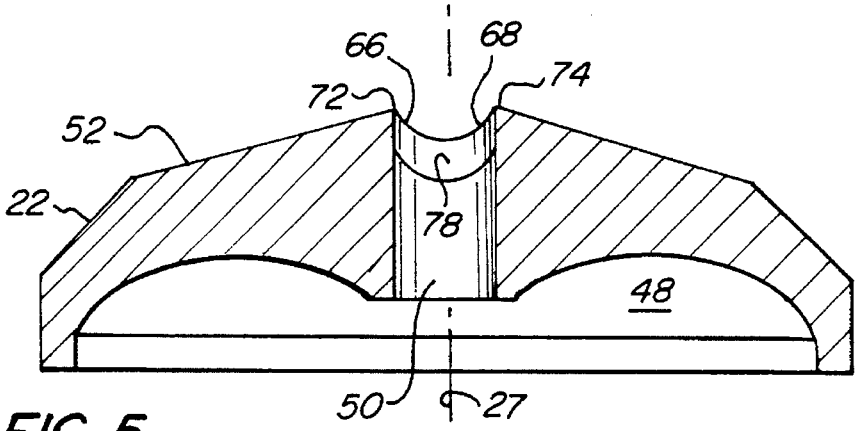
FIG. 5 is an enlarged section view of the spray plate taken along the lines 5—5 in FIG. 2.

With reference to FIGS. 1–6 a fuel atomizer 20 is shown formed of a spray plate 22, a whirl plate 24 and back plate 26. All of the plates have cylindrical perimeter surfaces so as to fit coaxially, about an axis 27, inside a cylindrical bore of a cap 28 which is threaded onto a pipe 30, shown in FIG. 6, to strongly clamp the plates together. The plates 22, 24, 26 nest with each other along flat polished surfaces so that opposite passages in the respective plates are surrounded by surfaces, which when pressed together by cap 28 form tight seals. The back plate is seated against suitable and conventional fuel supply conduits (not shown) and from which fuel is supplied at a very high pressure into an inner ring of apertures 32 in the back plate 26 and to which a return flow of fuel is directed from an outer ring of apertures 34.

FIG. 3 illustrates the axially inward surface 36 of the whirl plate 24. This surface has an annular rectangular cross-sectional groove 38 which is located radially opposite the inner ring of apertures 32 of the back plate 26 (see FIG. 6). The groove 38 surrounds an inner conically shaped through bore 40 the axially inward edge of which terminates at a perimeter wall 42. The wall 42 in turn has a plurality of straight channels 44 which are aligned to intersect tangentially with the perimeter wall 42. The axial depths of the channels 44 are selected commensurate with the desired amount of fuel flow.

Figure 6:
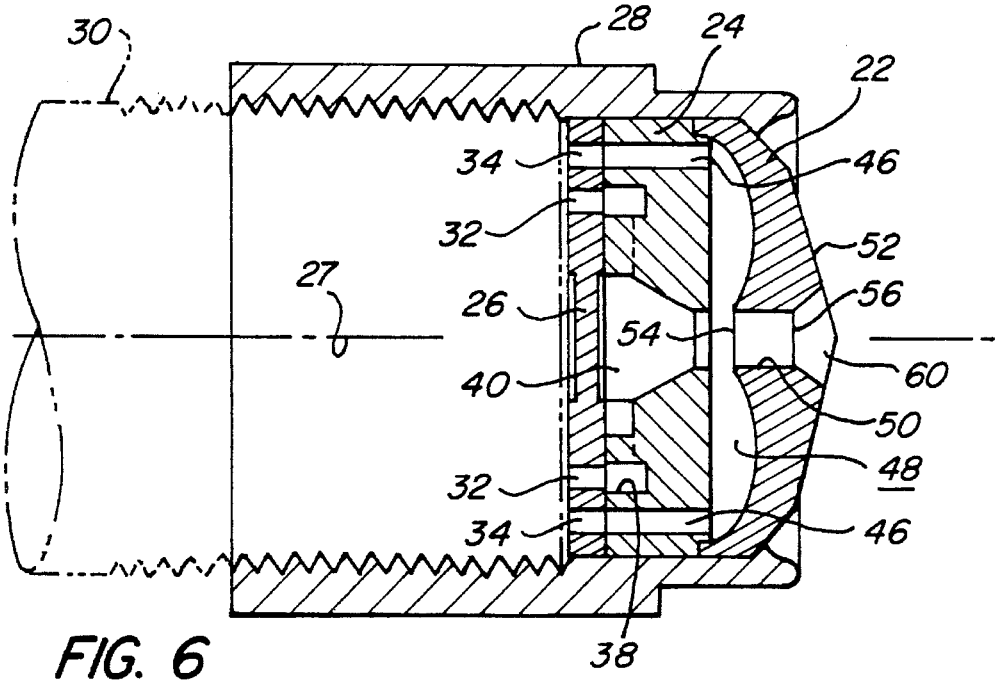
FIG. 6 is a section view of an assembled atomizer in accordance with the invention.

The whirl plate 24 further has a ring of through apertures 46 located opposite to and in alignment with the ring of through apertures 34 in the back plate 26 (see FIG. 6). The effect of the whirl plate 24 is to channel incoming fuel at a very high pressure, of the order of about 1000 psi, into a rotational flow within the conical through bore 40. The high degree of spin induced in the flow continues as the fuel moves through a chamber 48, between the whirl plate 24 and the spray plate 22, into a through bore 50 of the spray plate 22.

These features of the back plate 26 and the whirl plate 24 are well known. The invention, however, can also be used with a fuel atomizer wherein there is no return flow path for the fuel and thus no return flow apertures 46 from a chamber 48 and instead a direct transfer of the spinning fuel into bore 50 of the spray plate 22.

The spray plate 22 has an axially outwardly projecting domed surface 52, which surrounds its through bore 50. The domed surface 52 preferably is conically shaped centered at the axis 27, though other axially outwardly domed shapes can be used. The cylindrical through bore 50 has an inlet port 54 and an outlet port 56, which guides the fuel into an oblong slot 60 formed at the center of the domed surface 52.

Slot 60 intersects the through bore 50 and is bounded by a wall 62. The slot 60 is elongated along a central slot axis 64 which in turn intersects the axis 27. Wall 62 intersects the outwardly domed surface 52 along a pair of opposite parallel spaced apart edges 66, 68. These edges are inclined at an angle alpha relative to a plane 70 that is transverse to the axis 27 and is determined by the shape of the domed surface 50. Hence, edges 66, 68 have peaks 72, 74 and slope axially inwardly to the ends of the slot 60.

Figure 4:
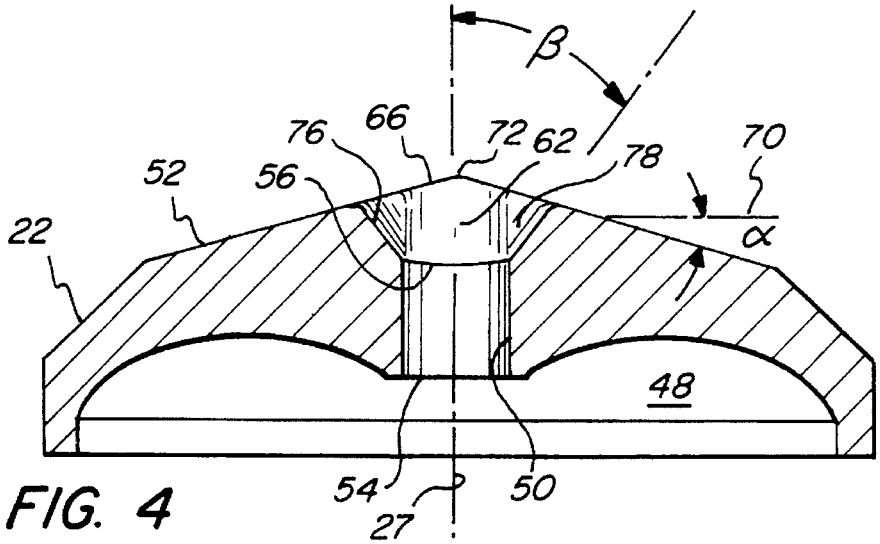
FIG. 4 is an enlarged section view of the spray plate taken along the lines 4—4 in FIG. 2.

As shown in the view of FIG. 4 the slot 60 is further so shaped that the wall 62 at the ends 76, 78 of the slot is inclined at an angle to smoothly merge with the smaller cross-section cylindrical wall of the through bore 50. The wall 62 at the slot ends 76, 78 is further curved along a radius of curvature centered at the axis 27 to provide smooth transitions from the outlet port 56 of the throughbore 50 to the slot 60.

Figure 7:
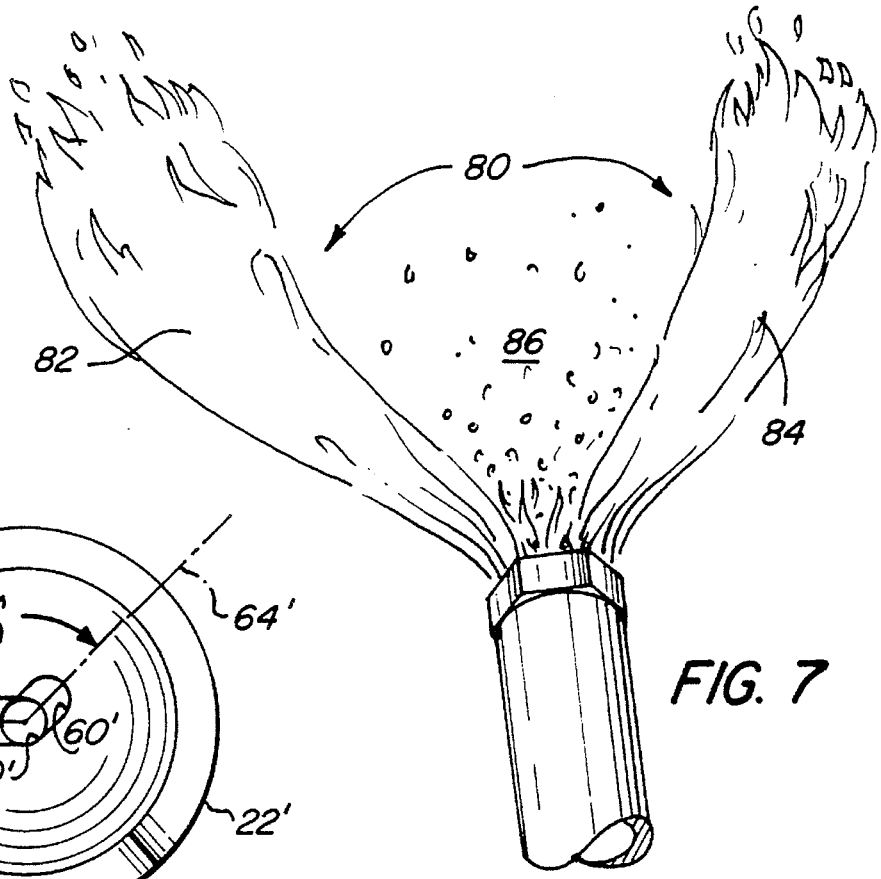
FIG. 7 is a perspective view of an atomizer in use in accordance with the invention.
Figure 13:
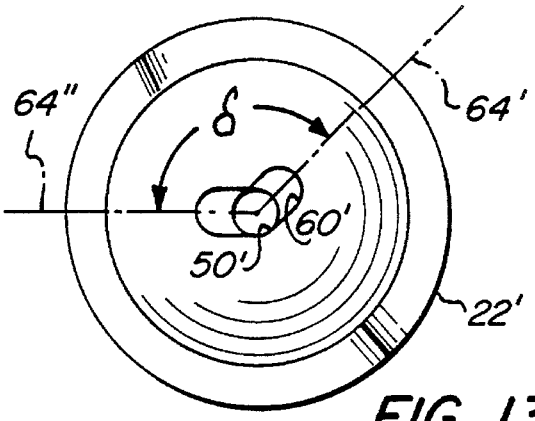
FIG. 13 is a top view of an alternate spray plate in accordance with the invention.
Figure 16:
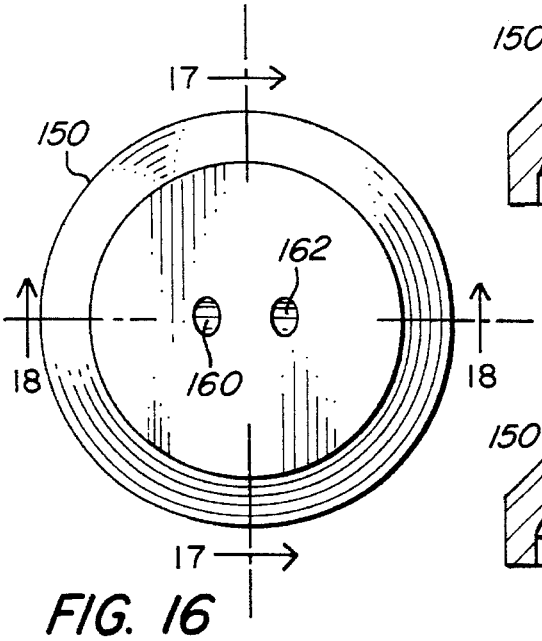
FIG. 16 is a plan view of another spray plate in accordance with the invention.

With an elongate slot 60 in spray plate 22 a bifurcated spray 80 is obtained as illustrated in FIGS. 7 and 16. This arises by virtue of the spin in the fuel as produced from the whirl plate 24. As the spinning fuel enters the throughbore 50 and then enters slot 60 the spin and the fuel pressure cause an expansion of the cross-section of the fuel stream. The fuel then preferentially expands, or spills, over portions of the slot wall 62 which are axially nearest, to the outlet port 56, or lower than the higher wall parts, while still being at least partially bounded by the slot wall 62. Since these lower portions are located towards the ends 76, 78 of slot 60, the fuel preferentially expands from these ends to form the bifurcated spray pattern 80 as shown in FIGS. 7 and 16.

The spray pattern is characterized by having rich fuel lobes or zones 82, 84 separated from each other by a fuel lean zone 86 containing a fine mist of fuel spray. The spray pattern 80 can be controlled by selecting the shape of the axially outwardly extending dome shaped surface 52 at the slot 60 and thus the size of the angle alpha of the edges 66, 68. The larger the angle alpha the lower the amount of fuel spills into the lean zone 86 and the more concentrated is the fuel in the fuel rich lobes 82, 84. When the angle alpha is too small the amount of fuel that is allowed to spill into the fuel lean zone 86 is increased and correspondingly the fuel rich zones 84, 86 become less concentrated. The angle alpha may thus vary and preferably is selected to be in the range from about 5 degrees to about 40 degrees.

In one embodiment for a fuel atomizer in accordance with the invention the angle alpha was 15 degrees on a spray plate of 2.234 inches in diameter having an outer domed surface diameter at about 1.7 inches. The width of the slot, i.e. the spacing between the opposite edges 66, 68 and the diameter of the through bore 50 was 0.277 inches and the angle beta of the slope of the wall 62 at the slot ends 76,78 was about 35 degrees as measured in a plane containing the intersecting slot and bore axes 27 and 64.

Figure 14:
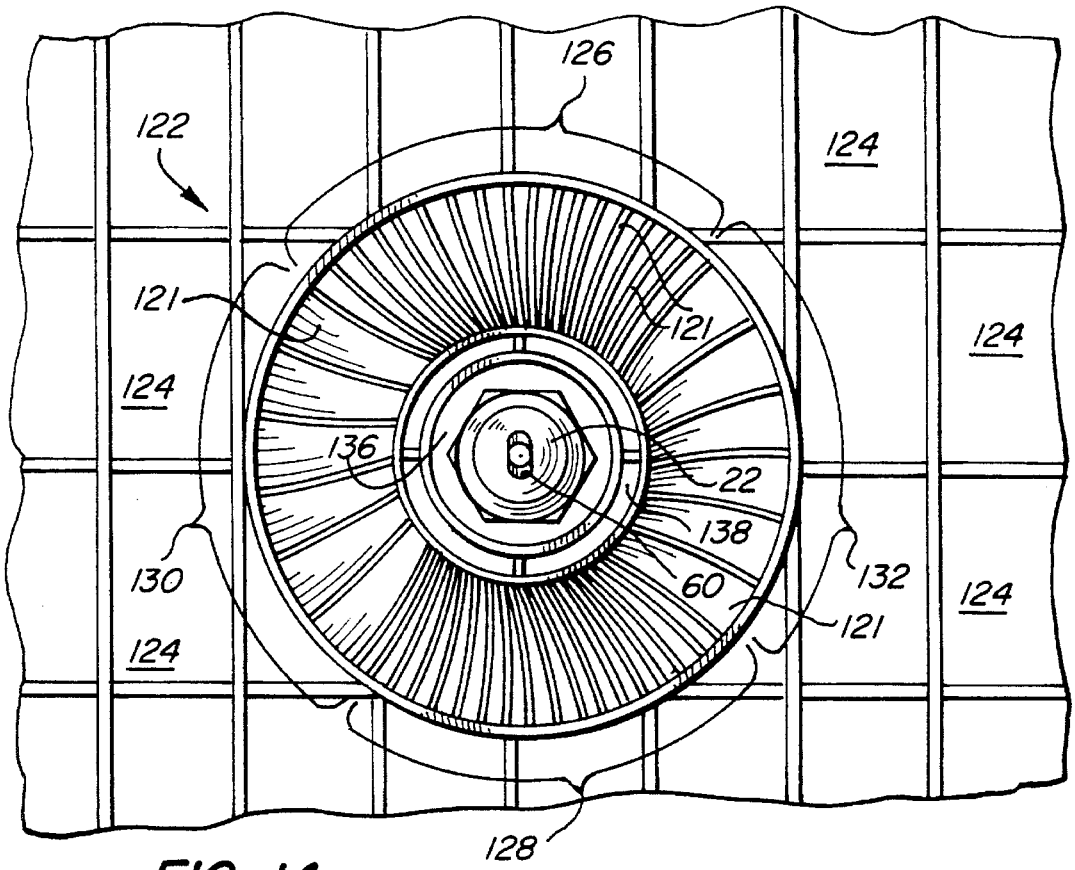
FIG. 14 is a front view in elevation of a burner using a liquid fuel atomizer in accordance with the invention inside a flame stabilizer mounted in the path of secondary air supplied to a boiler.

The slot 60 is shown as a straight cut into the domed surface 52 along the slot axis 64. It should be understood, however, that the slot 60 may be bent, such as shown at 60' in FIG. 14 so as to have a particular angle delta in a plane that is transverse to the discharge axis. Such bent slot 60' would still cause the fuel to preferentially spill out along fuel rich zones in generally different directions but somewhat closer and separated by a smaller fuel lean zone. The slot axis in such case would have two distinct sections 64' and 64" as illustrated in FIG. 14.

Figure 11:
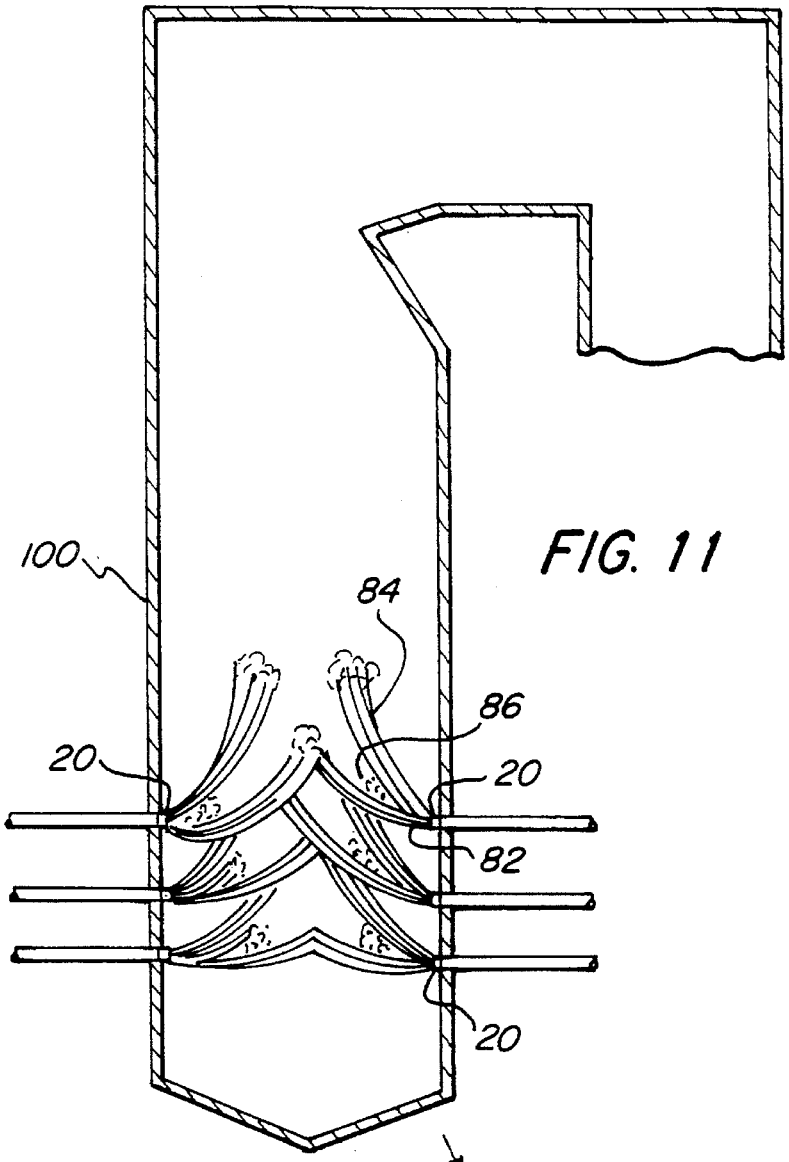
FIG. 11 is a vertical section view of a tangentially fired boiler using fuel atomizers in accordance with the invention.
Figure 12:
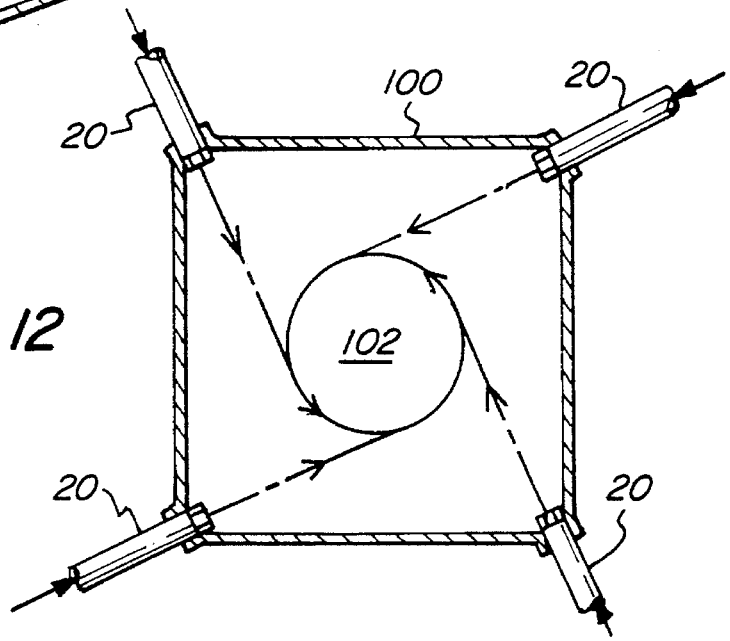
FIG. 12 is a horizontal section view of a tangentially fired boiler using fuel atomizers in accordance with the invention.

FIGS. 11 and 12 illustrate a typical implementation of the invention in a tangentially fired boiler 100. A plurality of fuel atomizers 20 in accordance with the invention are shown mounted at corners of the boiler 100 and are directed to each deliver separated fuel rich zones at a central flame region 102. The fuel flows are oriented so as to direct separated fuel rich zones 84 at different vertical portions of the central flame region 102. The orientation of the fuel atomizers can be altered so as to direct the separated fuel rich zones in a generally horizontal pattern. The fuel atomizers are each mounted within a flame stabilizer as further shown and described with reference to FIGS. 15 and 16.

In the generation of the separated fuel rich zones the thermal NOx can be substantially reduced by preventing the flame temperature from going too high. Thermal NOx was reduced from about 0.48 lbs/MMBTU to about 0.24 lbs/MMBTU. This NOx reduction was obtained without having to use special expensive low NOx producing burners.

Figure 8:
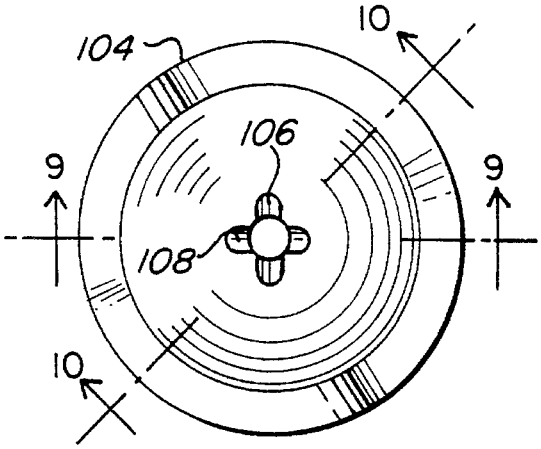
FIG. 8 is a plan view of another spray plate in accordance with the invention for use in a liquid fuel atomizer.
Figure 10:
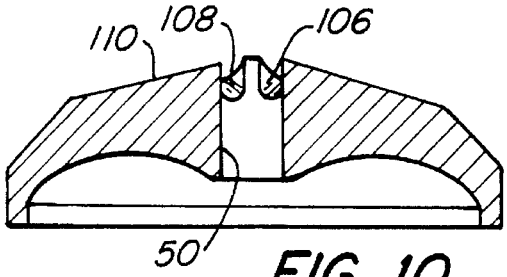
FIG. 10 is a section view of the spray plate shown in FIG. 8 and is taken along lines 10—10 therein.
Figure 9:
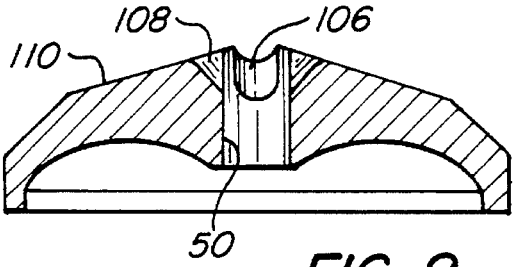
FIG. 9 is a section view of the spray plate shown in FIG. 8 and is taken along lines 9—9 therein.

FIGS. 8–10 illustrate a spray plate 104 in accordance with the invention wherein the single slot 60 is replaced with a pair of intersecting slots 106, 108 centered around a common throughbore 50 on a domed outer surface 110. The slots 106, 108 provide four fuel rich zones in the same manner as slot 60 as shown and described with reference to FIGS. 1–6. Other patterns may be considered to control and regulate the fuel delivery pattern for an optimized reduction of thermal NOx.

A highly stable flame and significant thermal NOx suppression was obtained by employing a liquid fuel atomizer 20 in accordance with the invention within the central bore 136 of a flame stabilizer 122. The flame stabilizer can be of the type as shown in U.S. Pat. Nos. 5,131,334 and 5,365,865 but preferably is of the type as described in a copending patent application entitled Internally Air Fuel Staged Flame Stabilizer by Richard J. Monro filed Oct. 27, 1993 bearing Ser. No. 08/144,230, now U.S. Pat. No. 5,415,114.

As described in the copending patent application and as shown in FIG. 14, the stabilizer 122 is placed in front Of some of the air flows introduced through ducts 124. The flame stabilizer 122 is formed with air deflecting vanes 121 which are so shaped as to produce a stabilized vortex with its base anchored at a desired location downstream of the vanes 121. The flame stabilizer 122 further has air restricting regions 126, 128 so as to produce air lean zones downstream of the flame stabilizer 122. The air restricting regions are angularly spaced from less restrictive regions 130, 132 which produce air rich zones downstream of the stabilizer 122. One technique for forming these angularly separate air rich and air lean zones is described in the above identified copending application, the contents of which, together with any patent as may issue therefrom, are incorporated herewith by reference thereto.

As described in the above patents and copending patent application, the swirl or vortex induced with the flame stabilizer 122 produces a vortex with an internal recirculation pattern 123 whose base is anchored in front of the stabilizer 122 so that the flame is anchored at a fixed distance in front of the fuel atomizer 20.

Figure 15:
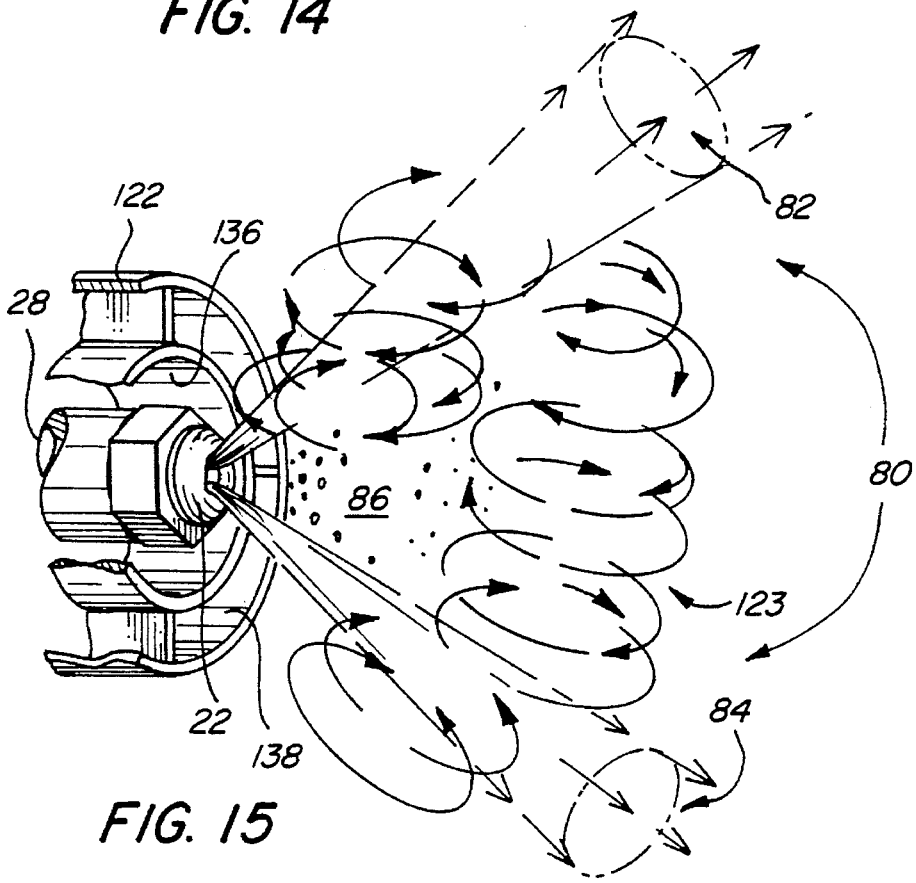
FIG. 15 is a partial perspective view of a burner shown in FIG. 14 showing the effects of the combination of a fuel atomizer in accordance with the invention and a flame stabilizer.

The fuel atomizer 20 in accordance with the invention and as shown in FIG. 14 is placed inside a central bore 136 through which air is supplied as well. The effect of stabilizer 122 is to produce a vortex with which a flame can be anchored in front of the fuel atomizer 20. The slot 60 in the spray plate of the fuel atomizer is aligned with the air lean regions 126, 128 so that the fuel rich lobes 82 and 84 as shown in FIG. 15 are aligned with corresponding lean air flows.

With such atomizer spray the fine mist of the fuel lean zone 86 can mix with the swirling air recirculating zone 123 to provide sufficient fuel to maintain ignition of a highly stable flame. The fuel in the fuel rich lobes 82, 84 is sufficiently concentrated to retard burning with air from the air lean regions 126, 128 to lower thermal NOx. The fuel rich lobes are sufficiently dispersed to maintain flammability with air flow from the air lean zones 126, 128 and from adjacent flows emerging from central conduits such as 136, 138.

The thermal NOx reduction is also attributable to the substantial reduction in the surface area of the concentrated fuel flows 82, 84 in comparison with the typical conically shaped liquid fuel spray patterns obtained with conventional atomizers. The surface area reduction can be of the order of as much as 5 to 1 or 80 percent and higher and promotes a reduction in the rate of the combustion reaction.

The stability of the flame obtained with a flame stabilizer and liquid fuel atomizer in accordance with the invention is enhanced. This improved stability arises because the internal recirculation pattern 123 in a vortex from a flame stabilizer tends to be disrupted by the typically conically shaped fuel spray from a conventional fuel atomizer. With the instant invention the fine spray in the fuel lean zone 86 aids ignition and stability without interfering with the internal circulation pattern while the concentrated liquid fuel lobes 82, 84 disrupt the internal circulation pattern 123 to a much lesser degree than a typical conically shaped fuel spray.

With the fuel atomizer in accordance with the invention optimization of thermal NOx reduction can be achieved by adjusting the rotational alignment of the slot 60 with respect to the air lean regions 126, 128 and the air rich regions 130, 132. The adjustment can such that the fuel rich lobes are aligned with the air rich regions and thus promote the mixing of the fuel with the air rich zones. Such alignment is achieved by either rotating the flame stabilizer 122 shown in FIG. 15 or the fuel atomizer slot by 90 degrees. In some applications significant reductions in thermal NOx can be achieved with a flame stabilizer which does not include circumferential air staging as obtained with the air lean and rich regions of stabilizer 122.

Figure 17:
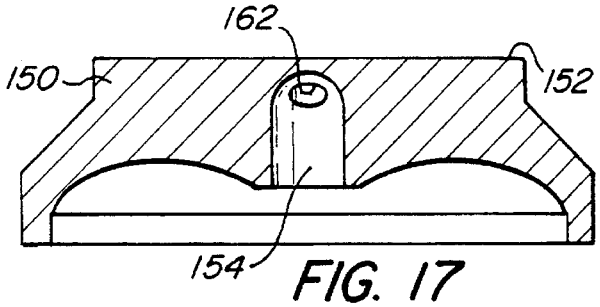
FIG. 17 is a section view of the spray plate of FIG. 16 taken along the line 17—17.
Figure 18:
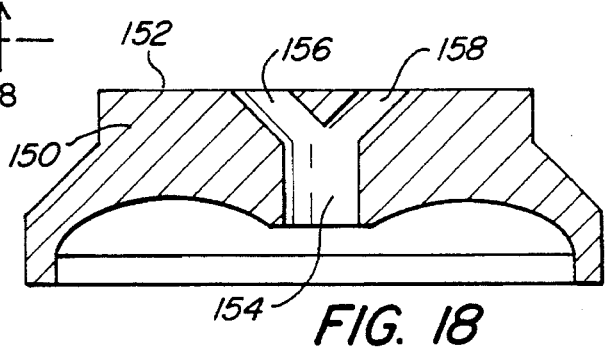
FIG. 18 is a section view of the spray plate of FIG. 16 taken along the line 18—18 therein.

The NOx reductions achieved with spray plates such as 22 and 104 of FIGS. 1 and 8 respectively are primarily attributable to the ability to produce concentrated lobes of liquid fuel. With reference to FIGS. 16–18 another spray plate 150 is shown for use with a back plate such as 26 and a whirl plate 24. As previously mentioned a spray plate such as 150 can also be used without a return flow of fuel as provided by the back plate 26. Spray plate 150 has angled liquid fuel discharge ports instead of a slot.

The spray plate 150 in this case has a flat top surface 152 with a centrally located bore 154 which is split into a pair of bores 156 and 158. The surface 152 can be domed or even concave. The bores 156, 158 are inclined relative to the central bore 154 and terminate previously mentioned a spray plate such as 150 can also be used without a return flow of fuel as provided by the back plate 26. Spray plate 150 has angled liquid fuel discharge ports instead of a slot.

The spray plate 150 in this case has a flat end surface 152 with a centrally located cylindrical bore 154 which is split into a pair of cylindrical bores 156 and 158. The surface 152 can be domed or even concave. The bores 156, 158 are inclined relative to the central bore 154 and the discharge axis to terminate at the surface 152 with elliptical discharge ports 160, 162. The angles of inclination can be varied and may be in the range from about 30 degrees to about 90 degrees from the discharge axis.

The highly spinning fuel emerges from the discharge ports 160, 162 with fuel streams that are concentrated and in angled directions, relative to the axis of bore generally as set forth for the spray plate of FIG. 1. The angular momentum of the spinning fuel assists in the conversion of the fuel streams into droplets. The use of the directional discharge ports 160, 162 yields a similar NOx reduction capability as he spray plate shown in FIG. 2.

Figure 19:
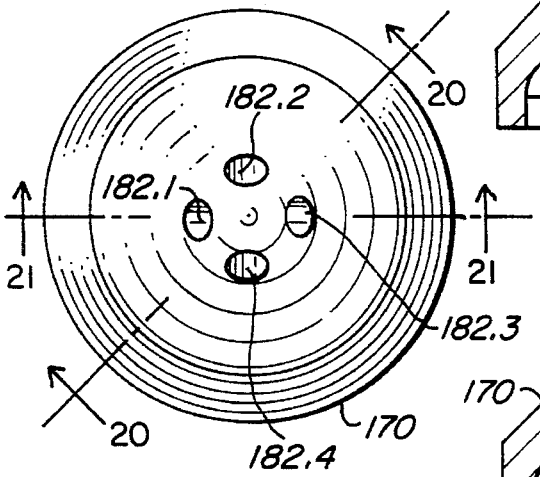
FIG. 19 is a plan view of still another spray plate in accordance with the invention.
Figure 20:
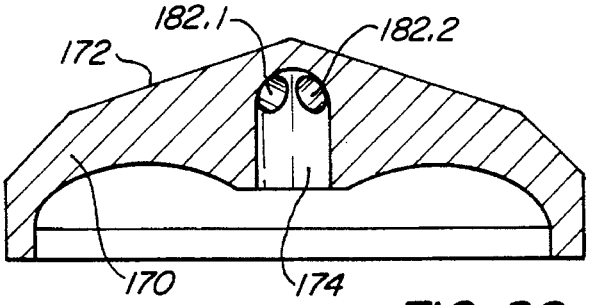
FIG. 20 is a section view of the spray plate of FIG. 19 taken along the line 20—20 therein.
Figure 21:
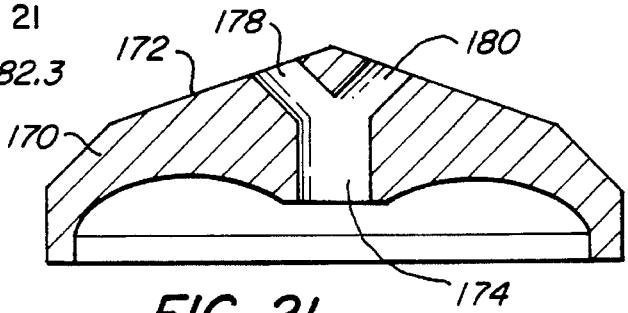
FIG. 21 is a section view of the spray plate of FIG. 19 taken along the line 21—21 therein.

FIG. 19 shows a spray plate 170 with a domed surface 172 and central liquid fuel bore 174. The bore 174 is split into four equi-angled bores, two of which 178, 180 can be seen in the view of FIG. 21. These bores terminate at the surface 172 and provide elliptically shaped directional discharge ports 182.1–182.4 for multiple concentrated lobes of fuel streams. The tangential momentum of the spinning liquid fuel spray

Having thus described fuel atomizers and an apparatus for the reduction of NOx in accordance with the invention its advantages can be appreciated. Variations of the described embodiment can be made without departing from the scope of the invention.

What is claimed is:

1. An apparatus for the reduction of NOx generated in a boiler from the burning of liquid fuel applied at high pressure, comprising:

means for generating a stream of fuel having a high spin around a discharge axis;

a fuel tip in the path of said spinning fuel stream, said fuel tip having a through bore aligned with the spinning fuel stream and extending from an inlet port to an outlet port;

said fuel tip having an end surface which has an outwardly extending domed shape and surrounds the discharge axis;

said end surface further having an oblong slot formed therein which intersects the outlet port of the through bore;

said oblong slot being bounded by a discharge wall;

said discharge wall intersecting said end surface along oppositely located spaced apart edges which are axially inclined at a desired angle with respect to a projection of the discharge axis on the discharge wall, so as to enable spinning fuel to preferentially spill over lower portions of the edges with velocity components capable of forming spaced apart fuel rich zones separated by a fuel lean zone.

2. The apparatus as claimed in claim 1 wherein the end surface of the fuel tip is so shaped that said desired angle of the edges is selected sufficiently small so as to avoid fuel rich zones in which the fuel is so concentrated that it becomes difficult to burn and wherein said desired angle is sufficiently large so as to assure the formation of separate spaced apart fuel rich zones.

3. The apparatus as claimed in claim 2 wherein said desired angle of the edges is in the range from about 5 degrees to about 40 degrees.

4. The apparatus as claimed in claim 3 wherein said desired angle for the edges is about 15 degrees.

5. The apparatus as claimed in claim 1 wherein said spaced apart edges are joined by oppositely located wall portions extending inwardly to intersect said through bore at its outlet port; said wall portions being inclined relative to said discharge axis to provide a desired flare along the slot axis for spinning fuel exiting from said through bore.

6. The apparatus as claimed in claim 1 wherein said fuel tip has at least a plurality of said slots oriented so as to intersect one another.

7. The apparatus as claimed in claim 6 wherein at least first and second of said slots are oriented so as to intersect each other at substantially a right angle.

8. An apparatus for reducing thermal NOx from a boiler in which liquid fuel is supplied to a flame ignition zone comprising:

a flame stabilizer placed to intercept air flow, said flame stabilizer having a plurality of radially extending vanes shaped to maintain a stabilized vortex with a recirculating air flow to anchor the flame ignition zone; said flame stabilizer including a plurality of angularly spaced air flow restricting regions and angularly spaced less restrictive air flow regions so as to produce circumferentially spaced air lean and air rich zones downstream of said flame stabilizer;

a liquid fuel supplier located generally concentric within the flame stabilizer so as to be surrounded by the radially extending vanes; said liquid fuel supplier producing concentrated liquid fuel lobes at angular positions that are generally angularly aligned with one of the air flow regions so that the liquid fuel lobes intermix with air zones for a thermal NOx reducing burning temperature; said liquid fuel supplier further delivering a mist of fuel into the recirculating air flow region of the vortex and in regions between the liquid fuel lobes to anchor the flame ignition zone.

9. The apparatus as claimed in claim 8 wherein the liquid fuel supplier is so aligned that the concentrated liquid fuel lobes are angularly aligned with air flow restricting regions so that the liquid fuel lobes intermix with air lean zones.

10. The apparatus as claimed in claim 8 wherein the liquid fuel supplier is so aligned that the concentrated liquid fuel lobes are angularly aligned with less restrictive air flow regions so that the liquid fuel lobes intermix with air rich zones.

11. The apparatus as claimed in claim 8 wherein the liquid fuel supplier comprises:

means for generating a stream of fuel having a high spin around a discharge axis;

a fuel tip in the path of said spinning fuel stream, said fuel tip having a through bore aligned with the spinning fuel stream and extending from an inlet port to an outlet port;

said fuel tip having an end surface which has an axially outwardly extending domed shape and surrounds the discharge axis;

said end surface further having an oblong slot formed therein which intersects the outlet port of the through bore;

said oblong slot being bounded by a discharge wall;

said discharge wall intersecting said end surface along oppositely located spaced apart edges which are axially inclined at a desired angle with respect to a projection of the discharge axis on the discharge wall so as to enable spinning fuel to preferentially spill over lower portions of the edges and discharge with velocity components capable of forming said spaced apart fuel rich lobes separated by a fuel lean zone formed of said fuel mist.

* * * * *